US005605065A

United States Patent [19]

Lopez-Casals et al.

[11] Patent Number: 5,605,065

[45] Date of Patent: Feb. 25, 1997

[54] MAGNETIC CONTROLLED LOCKING APPARATUS

[76] Inventors: Jesus Lopez-Casals; Jacques Sarthou, both of 42 Rue du Couriat, 63200 Riom (Puy-de-Dôme), France

[21] Appl. No.: 271,284

[22] Filed: Jul. 6, 1994

[30] Foreign Application Priority Data

Jul. 7, 1993 [FR] France ..... 93 08351

[51] Int. Cl.[6] ..... E05B 47/00

[52] U.S. Cl. ..... 70/276; 70/413

[58] Field of Search ..... 70/276, 413, 389

[56] References Cited

U.S. PATENT DOCUMENTS

| | | | |
|---|---|---|---|
| 3,420,077 | 1/1969 | Drazin | 70/276 |
| 3,602,020 | 8/1971 | Kajita | 70/276 |
| 3,797,288 | 3/1974 | Hallmann | 70/276 |
| 3,837,195 | 9/1974 | Delto | 70/413 X |
| 3,967,480 | 7/1976 | Stackhouse | 70/276 |
| 4,285,220 | 8/1981 | Kajita | 70/276 |
| 4,631,939 | 12/1986 | Herriott | 70/276 X |
| 5,074,136 | 12/1991 | Kim et al. | 70/413 X |

FOREIGN PATENT DOCUMENTS

| | | | |
|---|---|---|---|
| 9029720 | 8/1990 | Australia | 70/413 |
| 2541345 | 2/1983 | France . | |
| 1911413 | 9/1970 | Germany | 70/276 |
| 2238560 | 2/1974 | Germany | 70/276 |
| 2330014 | 1/1975 | Germany | 70/413 |
| 2807520 | 8/1979 | Germany | 70/276 |
| 3209946 | 9/1983 | Germany | 70/276 |
| 4041094 | 6/1992 | Germany | 70/413 |
| 7604725 | 11/1977 | Netherlands | 70/276 |
| 2201725 | 9/1988 | United Kingdom | 70/276 |

*Primary Examiner*—Suzanne L. Dino
*Attorney, Agent, or Firm*—Harrison & Egbert

[57] ABSTRACT

The apparatus is an improved magnetically operated locking device having a key and a cylinder. The cylinder has a longitudinal axis with a stator and a rotor. An interface is defined between the stator and the rotor. The rotor is rotatable by the key above the longitudinal axis of the cylinder. The improvement of the present invention includes a plurality of magnets on the key which are cooperative with a plurality of magnets mobile in the cylinder. The plurality of magnets on the key are gripped in sheaths of ferromagnetic material. The plurality of magnets on the cylinder are also gripped in sheaths of ferromagnetic material. The magnets of the cylinder are slidable in an area of the interface in holes formed within the cylinder. The plurality of magnets in the cylinder are slidable in the hole so as to lock the rotor against rotation relative to the stator. The magnets of the cylinder are magnetically identical and identically geometrically distributed as the plurality of magnets in the key.

11 Claims, 2 Drawing Sheets

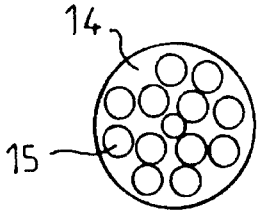
FIG. 4
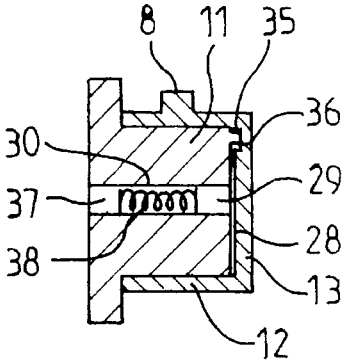
FIG. 5
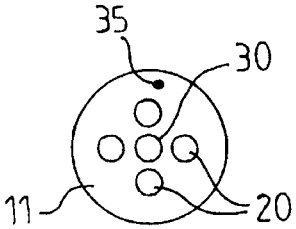
FIG. 6
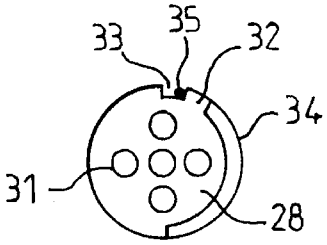
FIG. 7
FIG. 8
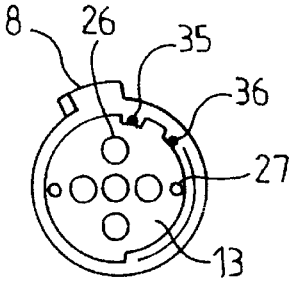
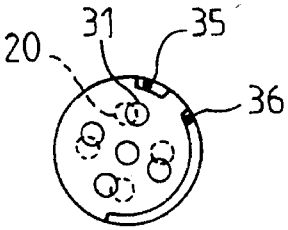
FIG. 9
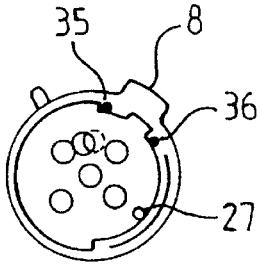
FIG. 10

MAGNETIC CONTROLLED LOCKING APPARATUS

TECHNICAL FIELD OF THE INVENTION

The present invention relates to a magnetically operated locking device. More particularly, it relates to a locking device of the key and cylinder type in which magnets provided in the area of the key cooperate with other mobile magnets in the cylinder.

BACKGROUND OF THE INVENTION

It is known that a conventional cylinder type locking device is generally installed in the stile of the door to be locked, that the cylinder is constituted by a fixed stator and a rotor that can be rotated by a key about the axis of the cylinder, that the different positions of the rotor in relation to the stator-controlled by the key-correspond to the locked or unlocked conditions of the device, and that the rotor is equipped with a mechanical member actuating the system for the locking or unlocking, properly speaking, of the door.

It is also known that the characteristic "combination" of the key can be mechanical; this is the most common case, in which the "code" is obtained by groupings of varying complexity; however, this code can also be magnetic. Such devices are already known, for example, from the description of French patent No. 2 541 345. In this patent, the rotor of the cylinder is pierced with radial openings through which pieces straddling the rotor-stator interface can tip to cause the device to be locked or unlocked. The tipping of these pieces is caused by the mutual actions of small magnets disposed transversely on the key and on the pieces.

However, the construction and assembly of these systems are often complicated, and thus fragile and expensive.

On the other hand, the risks of magnetic interaction make it necessary to space the magnets apart from one another and thus, for a given key and cylinder size, reduce the number, and thereby the quantity, of combinations possible.

The object of the present invention is to provide a magnetically operated locking device which makes it possible to remedy the aforementioned drawbacks by reducing the influence of mutual magnetic interaction between magnets.

Another object of the present invention is to provide a magnetically operated locking device that enables the accuracy of coding to be enhanced in order to preclude any risk of breaking in.

In addition, the device according to the invention offers numerous advantages. It enables the two sides of the door to be locked and unlocked, that is to say both the inside and the outside. Furthermore, the machining and mounting of these different elements are simple, hence inexpensive, as it allows all the operations to be performed, in particular, parallel to the axis of the cylinder. The number of codes, that is to say of possible combinations of the magnets and their implementation, is very large (several hundred million). Finally, the device is tight.

Further objects and advantages of the present invention will emerge from the following description, which is only given by way of example and which is not intended to limit same.

SUMMARY OF THE INVENTION

According to the present invention, a magnetically operated locking device is provided which is composed of a key and a cylinder. The cylinder has a longitudinal axis and includes a stator and a rotor defining therebetween an interface. The rotor is capable of being rotated by the key about the longitudinal axis of the cylinder. The device includes magnets on the key which cooperate with other magnets mobile in the cylinder. The magnets of the key and the magnets of the cylinder are gripped in sheaths of ferromagnetic metal. The magnets of the cylinder are designed so as to be able to slide, in the area of the interface, in holes provided in the stator and/or in holes provided in the rotor, in such a way so as to lock the rotor against rotation. The magnets of the cylinder and those of the key are disposed with the same geometrical distribution and are magnetically identical.

The invention will be more readily understood with reference to the following description, as well as to the annexed drawings, which form an integral part thereof.

BRIEF DESCRIPTION OF THE DRAWINGS

FIG. 4 is a cross-sectional view of the key;

FIG. 5 is a partial cross-sectional view of the cylinder according to the particular form of embodiment shown in FIGS. 1 and 2;

FIGS. 6 to 10 are simplified front views of the particular form of embodiment shown in FIGS. 1 and 2, which illustrate more particularly the relative positions of the stator and the rotor in different cases;

DETAILED DESCRIPTION OF THE INVENTION

Figure 1:
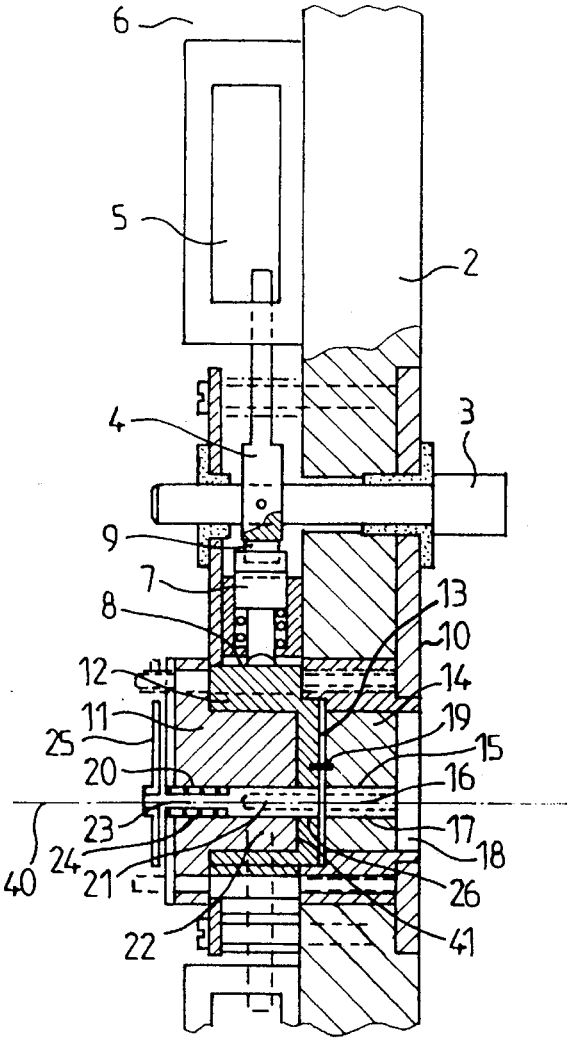
FIG. 1 is a cross-sectional view in a plane perpendicular to that of the door showing a particular form of embodiment of the locking device.

As can be seen from FIGS. 1 and 10, the magnetically operated locking device according to the invention is composed of a key 14 and a cylinder 1. This cylinder has a longitudinal axis 40 and comprises a stator 11 and a rotor 12 which define between them an interface 41.

The rotor 12 can be rotated by the key 14 about the longitudinal axis 40 of the cylinder. In rotating, the rotor locks and unlocks the device for opening and closing the element in which the device according to the invention is installed.

Furthermore, the latter also includes magnets 16 provided at the key 14 which cooperate with other magnets 21 mobile in the cylinder 1.

According to the invention, magnets 16 of the key and magnets 21 of the cylinder are gripped in sheaths 22 of ferro-magnetic material, the purpose of which is described herebelow. They are suitable, in particular, for concentrating the lines of magnetic flux.

Furthermore, to enable rotor 12 to be locked against rotation, magnets 21 of the cylinder are designed so as to be slidable in the area of interface 41. They are mobile in holes 20 provided in stator 11 and/or in holes 26 provided in rotor 12.

Thus, when these mobile elements straddle interface 41 they prevent any rotational movement about the axis of the cylinder and thus lock the device. On the other hand, when they are placed on one side or the other of the interface, rotation is free and the device is unlocked.

Further according to the invention, magnets 21 and 16 of the cylinder and of the key, respectively, are arranged according to the same geometrical distribution and are identical magnetically face to face. Thus, the geometrical dimensions, the magnetic characteristics and the relative dispositions of the the magnets of the cylinder and of the key are rigorously identical.

In one particular case, the north-south magnetic orientations of magnets 21 and those of magnets 16 can be identical and, in this case, they attract one another when they are face to face. In a second particular case, their north-south orientations can also be inverted and, in this case, they repel one another when they are face to face. It is the latter arrangement that will be generally preferred as it produces forces more efficient in displacing the mobile elements.

In addition, the diameters of holes 20, 26 of the stator and of the rotor are also rigorously identical and the holes are geometrically distributed in the same way.

According to an advantageous form of embodiment of key 14, the key is composed of a body of amagnetic material, such as aluminium, for example. Magnets 16 are placed inside this body in holes 15, the diameter and geometrical distribution of which are identical with those of cylinder 1. They are, for example, perpendicular to the front face 10 of the key; magnets 16 being, for example, small in size and of an elongated shape.

Figure 3A:
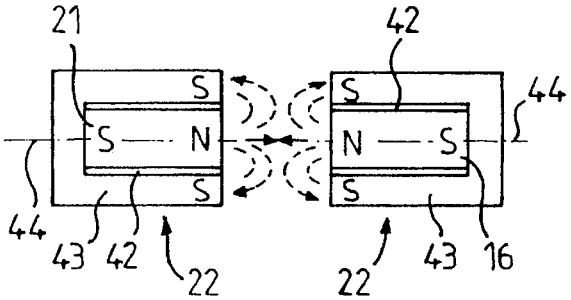
FIGS. 3*a* and 3*b* are diagrams illustrating the part played by the sheathes.
Figure 3B:
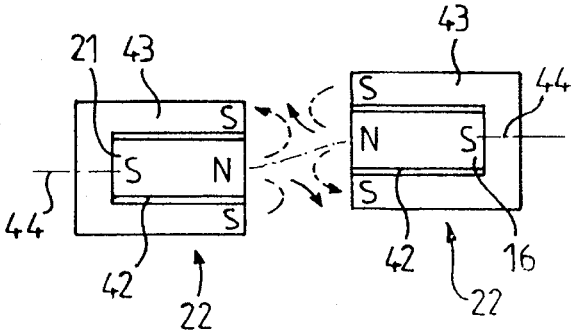

According to FIGS. 3*a* and 3*b*, sheaths 22 of ferro-magnetic material are formed by an amagnetic sleeve 42 and a yoke 43 of ferro-magnetic material. They are thus capable of concentrating the magnetic flux from magnets 16 and 21 in a given direction to increase the coding accuracy.

The two magnets are gripped in their sheaths, in which they are fixed, for example, with ARALDITE. They are placed exactly opposite one another, with the poles of the same sign facing each other. Because of ferro-magnetic yokes 43, the lines of the field are highly concentrated and rigorously symmetrical.

Thus, in the case of FIG. 3*a*, they produce a force of maximum mutual repulsion. On the other hand, in the case of FIG. 3*b*, the two magnets are slightly offset and the effect is completely reversed: the two magnets attract one another.

In other words, the definition of the magnetic code is considerably increased by this arrangement according to the present invention.

Indeed, because of the combination of the amagnetic sleeve 42 and of the ferro-magnetic sheath 43, the pole of the magnet located at the end of the yoke is brought to the front face. As a result, a multiple polarity magnet is obtained instead of a single polarity magnet. Hence, there is an increased need for identity between the magnets 21 of the cylinder and the magnets 16 of the key.

This identity requirement also concerns the respective diameters, for each of the magnets of the cylinder and of the key, of the yoke, of the sleeve and of the magnets.

Furthermore, it is also possible, to increase the accuracy of coding so as to exploit the intensity of the magnetizing power of the different magnets.

Another advantage of ferro-magnetic sheaths 22 is that they reduce the interactions because of the concentration of the lines of flux, and to thus make it possible to increase the number of magnets and to achieve a practically unlimited number of different codes.

As shown in FIGS. 1 and 10, magnets 16 of key 14 and magnets 21 of cylinder 1 have magnetic axes the directions of which are parallel to axis 40 of the cylinder while the device is being manipulated.

This arrangement makes it possible to carry out all the operations parallel to the axis of the cylinder, which simplifies its operation and thus facilitates the machining and mounting of its different elements.

Holes 20 in the stator are, for example, provided with compression springs 24, capable of pushing back magnets 21 of cylinder 1 into locking position. Holes 26 of rotor 12 are, for example, closed on the side facing the key, either by forming blind holes or by means of a plate mounted on the outer face of the rotor.

Also as shown in FIGS. 1 and 10, sheaths 22 of ferro-magnetic metal in which the magnets are gripped, are, in particular, open on the front face side of the key, in the case of magnets 16 of the key and, in particular, on the end side of the rotor, in the case of magnets 21 of the cylinder. Their axis is, for example, parallel to the axis of cylinder 1.

Furthermore, mechanical coupling means, of any known type, are provided on the outer face of the end of rotor 12 and on the front face of key 14.

These means may be, for example, two pins such as 19, the function of which is, on one hand, to ensure the correct positioning of the key in relation to the cylinder and, on the other hand, to drive rotor 12 in rotation after it has been unlocked. It also enables the rotational torque to which the device is subjected to be limited. To control and facilitate this rotation, key 14 is provided, for example, with a gripping element of any known type, such as, for instance, a strip 18.

The device according to the invention operates as follows: when the key is presented correctly opposite the cylinder, that is pins 19 are engaged in the holes 27 provided in the outer face of the end of the rotor, magnets 16 of the key push back magnets 21 of the cylinder against the bias of springs 24. These small displacements disengage interface 41 and thus release rotor 12 for rotation, which is obtained by turning the key.

In this connection, it is to be noted that the force of magnetic repulsion must correspond to the stiffness of springs 24, failing which the small displacements of magnets 21 will either be excessive or too limited and interface 41 will remain immobilized. This characteristic further enhances the security of the device.

In addition, given the material of which they are made and their number, sheaths 22 possess shearing strength such that it is impossible to rotate the rotor with an implement capable of engaging in the housing for the key and, should use be made of a key having the same pin arrangement but a different magnetic code, and thus unable to repel magnets 21, if one were to try to force the rotor to rotate, the pins would be sheared, but not sheaths 22.

Finally, according to the invention, it is always possible to reduce the depth of the housing for the key in the device in order to make even an attempt at breaking in impossible.

Figure 2:
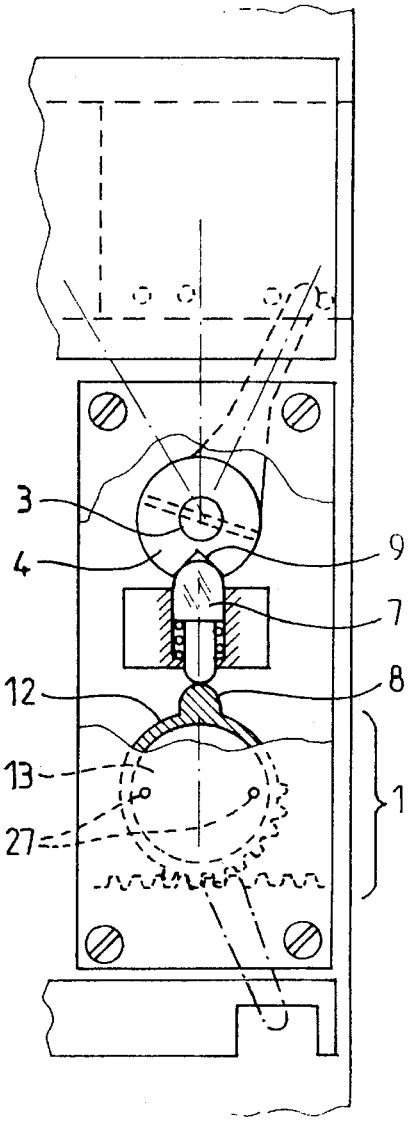
FIG. 2 is a partial cross-section according to FIG. 1 in a plane parallel to that of the door according to FIG. 3.

In the following paragraphs, the first form of embodiment is more particularly described, as shown in FIGS. 1 and 2. The device is installed as a whole in the stile 2 of the door to be locked. In a known manner, a handle 3 passing through stile 2, is provided with a comb memher 4 capable of penetrating a striking plate 5 fixed in the casing 6 of the door. Rotation of the handle about its axis, which enables the door to be opened or closed, can be locked by the cylinder device in various ways. In the system shown, a slide 7, actuated by an eccentric 8 of the rotor of the cylinder cooperates with a countersunk portion 9 in handle 3.

Rotor 12 takes the form of a cylindrical dish that surrounds stator 11. Magnets 21 of cylinder 1 are mounted slidably in the stator 11.

Sheaths 22 comprise an axial appendage, such as 23, around which is mounted compression spring 24, which bears against the rear of stator 11. The appendages are fixed to a plate 25 parallel to the door which enables the device to be operated from the inside.

It suffices, in fact, to pull it backwards in order to cause the assembly of magnets 21 to move back and thus unlock the rotor to neutralize the present device. Conversely, in order to bring the device into service from the inside, it suffices to push back plate 25 and to lock it in this position using any means known to a man having ordinary skill in the art.

According to the present invention as shown in FIGS. 5 and 10, the magnetically operated locking device includes a thin metallic washer 28 between the rotor 12 and the stator 11. This washer has openings 31 precisely matching with holes 20 of the stator and/or holes 26 of the rotor. It is capable of being subjected to angular displacement about the longitudinal axis of the cylinder so as to prevent the magnets of the cylinder from dropping back into one of the holes during rotation of the rotor.

Indeed, as can be seen from FIGS. 9 and 10 which is a simplified cross sectional view, the rotation of the key, hence that of the rotor, can cause different magnets to travel past the stator in the same relative positions, which would have the effect of disturbing the operation of the device, which would not recognize the magnetic code thus presented. The washer makes it possible to avoid this drawback and thus further increase the number, already very high, of possible codes of the device by using for each existing combination of the magnets, different angular positions of the rotor, because of this additional piece.

According to a first form of embodiment, shown in detail in FIGS. 5 to 10, the angular displacement of washer 28 is obtained as follows.

The metallic washer comprises a central pivot 29 journalling in an axial hole 30 of stator 11, in the end of which it is placed; openings 31 of the washer precisely matching with holes 20 of stator 11. Furthermore, this washer comprises a radial projection 32 formed by two peripheral cut out portions 33 and 34, this projection being capable of cooperating with two pins 35, 36 integral respectively with the stator and the rotor. These pins are placed at an angular distance less than that of two contiguous holes in the same orbit. Finally, axial hole 30, closed by a plug 37, contains a torsion spring 38 exerting its torque between plug 37 and pivot 29 of washer 28.

The operation of this washer 28 is described in detail with reference to FIGS. 6 to 10. FIG. 6 is a simplified front view of stator 11. It can be seen to have four holes, such as 20, containing magnets 21 (not shown), axial hole 30 and pin 35. In FIG. 7, it can be seen the washer 28 placed in front of the stator, which is not visible, four holes such as 31 corresponding to holes 20 in the stator, radial projection 32 between the two peripheral cut out portions 33 and 34, and pin 35. FIG. 8 shows the end 13 of rotor 12 placed in front of washer 28, the four holes such as 26 corresponding to the preceding ones, pin 35 of the stator and pin 36 fixed in the end of the rotor, on the inner side, as well as eccentric 8 which controls the locking, properly speaking, of the lock. FIGS. 6, 7 and 8 show the different members in rest position, that is to say with the device locked.

The sequence of opening or unlocking operations is as follows: key 14 having been correctly placed (pins 19 in holes 27), magnets 16 of the key repel those, 21, of the stator, thus releasing rotor 11 and washer 28 for rotation. The torsion spring 38 then causes washer 28 to rotate until it is brought into abutment with pin 35 of the stator. This position, which is represented in FIG. 9, is one of slight angular displacement between the stator and the washer, which thus masks holes 20 of the stator, preventing the magnets of the latter from returning to their initial positions, which would cause locking against any rotation.

From this position, continued rotation of the key causes rotation of the rotor, without causing that of washer 28, which thus continues to mask the magnets of the stator. This key-rotor rotation ends in abutment when unlocking is achieved, for example when eccentric 8 has finished releasing slide 7, by any known means. In this final condition, the above elements are in the positions shown in FIG. 10.

To re-close or re-lock the device, the key is rotated in the opposite direction, which firstly causes the rotor also to rotate in the oppposite direction, until pin 36 of the rotor pushes back radial projection 32 of washer 28 to return it to its initial position. Then, the magnets of the stator, pushed by compression springs 24, return into holes 31 of washer 28 and the holes 26 of the rotor, which has the effect of re-locking the latter.

Because of this first form of embodiment, it is possible to take advantage of 0 to 250 degrees of rotation of the rotor, which makes it possible to actuate several bolts.

To conclude, it can be seen that the advantages offered by the present invention are very numerous and of great interest. Firstly, there are a large number of possibilities. With a cylindrical key having a diameter of 2 mm and 14 housings for the magnets, it is possible to obtain over seven million combinations, with only 8 magnets.

Code reading is extremely accurate because of the ferromagnetic sheaths.

The mechanism is simple and efficient, making for easy, inexpensive industrial production.

Any attempt at breaking in destroys the rotor, thus eliminating the only means of opening the device.

The key can be of any shape and can be surrounded by an anti-magnetic cover.

A number of variants of the device as described could, of courser be produced without thereby departing from the scope of the invention. Thus, for example, the number of possible codes could be further increased by modifying the shapes of elements such as the magnets (cylindrical, tubular or other shapes), of the sheaths or of the magnetic field in the vicinity of these elements.

What is claimed is:

1. An improved magnetically generated locking device having a key and a cylinder, the cylinder having a longitudinal axis and having a stator and a rotor, an interface being defined between the stator and the rotor, the rotor is rotatable by the key about the longitudinal axis of the cylinder, the improvement comprising:

a plurality of magnets on the key which are cooperative with a plurality of magnets mobile in the cylinder, said plurality of magnets on the key being gripped in sheaths of ferromagnetic material, said plurality of magnets on the cylinder being gripped in sheaths of ferromagnetic material, said plurality of magnets of the cylinders slidable in an area of the interface in holes formed therein, said plurality of magnets of the cylinder being slidable in said holes so as to lock the rotor against rotations relative to the stator, said plurality of magnets of the cylinder being magnetically identical and of an identical geometrical distribution as said plurality of magnets of the key, each of said sheaths of ferromagnetic material of the cylinder and of the key having an magnetic sleeve means extending therearound and a yoke means of ferromagnetic material receiving said magnetic sleeve therein, said magnetic sleeve means and said yoke means for concentrating a magnetic flux of said plurality of magnets in a given direction.

2. The improvement according to claim 1, wherein said plurality of magnets of the key and said plurality of magnets of the cylinder have magnetic axes parallel to the axis of the cylinder.

3. The improvement according to claim 2, said holes being formed in the stator and in the rotor of the cylinder, said holes receiving compression spring means on a side opposite to that of the key, said compression spring means for repelling the plurality of magnets of the cylinder into a locking position while the holes in the rotor are closed on a side facing the key.

4. The improvement according to claim 2, wherein said sheaths of ferromagnetic material of the key are open in a direction of a front face of the key.

5. The improvement according to claim 2, wherein said sheaths of ferromagnetic material of the cylinder are open in a direction toward an end of the rotor.

6. The improvement according to claim 2, wherein a mechanical coupling is provided in an outer face of an end of the rotor and on a front face of the key.

7. The improvement according to claim 2, further comprising:

a washer between the rotor and the stator, said washer having openings precisely matching with the holes of the cylinder, said washer being capable of being subjected to an angular displacement about the longitudinal axis of the cylinder as to prevent the magnets of the cylinder from falling back into one of said holes during a rotation of the rotor.

8. The improvement according to claim 2, wherein the rotor is of cylindrical dish form which surrounds the stator, said plurality of magnets of the cylinder are mounted slidably in the stator.

9. The improvement according to claim 2, wherein the plurality of magnets of the cylinder are mounted slidably in the rotor.

10. The improvement according to claim 7, wherein the washer is placed in an end of the stator and comprises a radial projection cooperative with two pins integral respectively with the stator and with the rotor.

11. The improvement according to claim 10, wherein the washer is rotatable about a pivot that journals in an axial hole of the stator under an action of a torsion spring housed in said axial hole.

* * * * *